US007581368B1

(12) United States Patent
Bison

(10) Patent No.: US 7,581,368 B1
(45) Date of Patent: Sep. 1, 2009

(54) PALLET ROPING AND WRAPPING APPARATUS

(76) Inventor: Darrel Bison, 5640 S. 16th St., Phoenix, AZ (US) 85040

( * ) Notice: Subject to any disclaimer, the term of this patent is extended or adjusted under 35 U.S.C. 154(b) by 0 days.

(21) Appl. No.: 11/668,954

(22) Filed: Jan. 30, 2007

Related U.S. Application Data

(60) Provisional application No. 60/829,339, filed on Oct. 13, 2006, provisional application No. 60/829,085, filed on Oct. 11, 2006.

(51) Int. Cl.
*B65B 11/04* (2006.01)
*B65B 53/00* (2006.01)

(52) U.S. Cl. ..... 53/399; 53/587; 53/589

(58) Field of Classification Search ..... 53/399, 53/441, 556, 587, 588, 589, 211, 218
See application file for complete search history.

(56) References Cited

U.S. PATENT DOCUMENTS 2,026,282 A * 12/1935 Leguillon ..... 206/451
3,896,604 A * 7/1975 Marantz ..... 53/176
4,102,513 A * 7/1978 Guard ..... 242/423.1
4,166,589 A * 9/1979 Hoover et al. ..... 242/423.1
4,235,062 A * 11/1980 Lancaster et al. ..... 53/399
4,255,918 A * 3/1981 Lancaster et al. ..... 53/556
4,353,515 A * 10/1982 Weaver et al. ..... 242/423.1
4,468,922 A * 9/1984 McCrady et al. ..... 57/402
4,619,102 A * 10/1986 Geisinger ..... 53/399
4,807,427 A * 2/1989 Casteel et al. ..... 53/556
4,845,920 A * 7/1989 Lancaster ..... 53/399
4,961,306 A * 10/1990 Sawhney et al. ..... 57/12
5,031,771 A * 7/1991 Lancaster ..... 206/442
5,079,898 A * 1/1992 Springs et al. ..... 53/399
5,107,657 A * 4/1992 Diehl et al. ..... 53/141
5,125,209 A * 6/1992 Thimon et al. ..... 53/399
5,168,685 A * 12/1992 Suzuki ..... 53/141
5,195,297 A * 3/1993 Lancaster et al. ..... 53/399
5,203,939 A * 4/1993 Sperling et al. ..... 156/148
5,315,808 A * 5/1994 MacIvor et al. ..... 53/399
5,385,001 A * 1/1995 Ramer ..... 53/399
5,447,009 A * 9/1995 Oleksy et al. ..... 53/399
5,965,262 A * 10/1999 Whisler et al. ..... 428/373
6,164,047 A * 12/2000 Rossi ..... 53/587
6,745,544 B2 * 6/2004 Matsumoto et al. ..... 53/399
6,892,515 B2 * 5/2005 Cere' ..... 53/586
6,971,220 B1 * 12/2005 Rampp ..... 53/441
2008/0092489 A1 * 4/2008 Smith ..... 53/430
2008/0209859 A1 * 9/2008 Vanderheiden et al. ..... 53/399

* cited by examiner

*Primary Examiner*—Paul R Durand
(74) *Attorney, Agent, or Firm*—Booth Udall, PLC

(57) ABSTRACT

Pallet roping and wrapping machines having a plurality of spools of stretch film supported on a single spool and guides that form ropes of stretch film without cutting. Specific implementations of guides include guides formed or rings and rollers. Positions of guides may be adjustable.

18 Claims, 7 Drawing Sheets

PALLET ROPING AND WRAPPING APPARATUS

CROSS REFERENCE TO RELATED APPLICATIONS

This document claims the benefit of the filing date of U.S. Provisional Patent Application No. 60/829,339, entitled HAND ROPER, which was filed on Oct. 13, 2006, and of the filing date of U.S. Provisional Patent Application No. 60/829,085, entitled RAPID ROPER, which was filed on Oct. 11, 2006, the contents of both of which are hereby incorporated by reference.

BACKGROUND

1. Technical Field

Aspects of this document relate generally to securing and protecting palletized loads.

2. Background Art

Goods to be transported in containers on, for example, ships, trucks, trains or the like frequently are packed on pallets. Such palletized goods or material, further, may be wrapped in stretch film in order to protect the material from damage caused by, for example, shifting on a pallet or being bumped by goods on adjacent pallets.

Material such as furniture or boxed goods may be completely wrapped in contiguously overlapping stretch film, effectively sealing wrapped material from contact with air or from contact with other material, which may be, for example, on other pallets. However, other types of material, such as, for example, fresh fruits and vegetables, require that air be allowed to circulate among the palletized material in order to prevent buildup of condensation or to aid in cooling or warming the material. One known method for packing these kinds of goods includes wrapping the palletized material in netting, or with a rope rather than in stretch film.

SUMMARY

In one aspect, particular implementations of pallet wrapping and roping machines comprise an apparatus for securing a palletized load, the apparatus comprising a spool support member. In another aspect, particular implementations may comprise a plurality of rolls of stretch film on a single spool, the spool being supported by the spool support member. In yet another aspect, particular implementations may comprise a guide support member oriented substantially parallel to the spool and sharing mechanical support with the spool support member. In still yet another aspect, particular implementations may comprise a plurality of guides coupled to the guide support member, each guide having stretch film from a roll of the plurality of rolls passed through the guide, thereby forming a plurality of ropes of stretch film, each stretch film roll remaining uncut by the apparatus.

For other particular implementations, the plurality of rolls comprises two rolls.

For still other particular implementations, the plurality of rolls of stretch film on a single spool comprises rolls positioned essentially contiguously on the spool.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Various aspects of implementations of pallet wrapping and roping machines will hereinafter be described in conjunction with the appended drawings, where like designations denote like elements, and.

DESCRIPTION

This disclosure, its aspects and implementations, are not limited to the specific devices and methods disclosed herein. Many additional elements, components, and procedures known in the art consistent with the intended use of the apparatus and methods described will become apparent for use with various implementations of pallet-wrapping apparatus and techniques from this disclosure. Accordingly, for example, although a particular apparatus may be disclosed, such apparatus may comprise any shape, size, style, type, model, version, material, and/or the like as is known in the art for such apparatus, consistent with the intended operation of the devices described herein.

Figure 1:
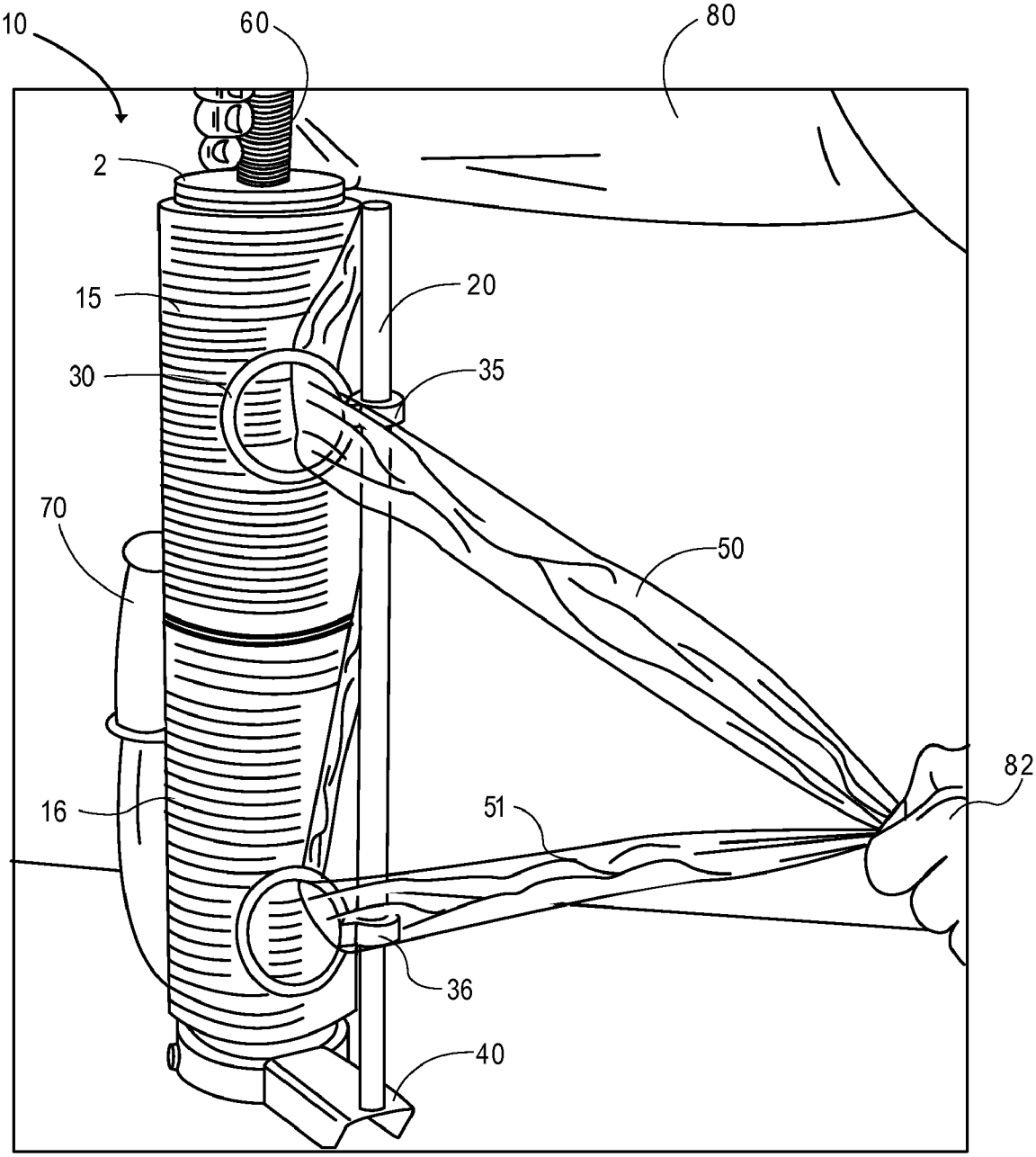
FIG. 1 is a pictorial diagram of a particular implementation of an apparatus for wrapping palletized loads.

A particular implementation of a pallet roping and wrapping apparatus 10, which may be employed for securing a palletized load, is shown in FIG. 1. The apparatus 10 comprises a first roll 15 and a second roll 16 of stretch film and a single spool 2 configured to support the first and second rolls 15 and 16 of stretch film. The first and second rolls 15 and 16 may be positioned essentially contiguously on the spool 2. The apparatus 10 further may comprise a baseplate 40 and a spool support member (which may be a rod, not shown) adapted to support the spool 2, the spool support member having an end affixed to and supported by the baseplate 40. The spool 2 may have an axis that typically coincides with a center axis shared by the first and second rolls 15 and 16 of stretch film. The illustrated implementation still further comprises a pair of guides, first guide 30 and second guide 31, and a guide support member 20, which may comprise, for example, a rod. The guide support member 20 may have an end coupled to and supported by the baseplate 40. That is, the spool support member and the guide support member 20 may share mechanical support provided by the baseplate 40. The guide support member 20 may have an axis oriented to be substantially parallel to the axis of the spool 2 in normal operation. In the illustrated implementation of FIG. 1, the first and second guides 30 and 31 are formed as rings. First guide 30 is secured to the guide support member 20 by a first collar 35 that may be adjustably positioned on the guide support member 20 at a location nominally opposite a midpoint of the first roll 15. Likewise, second guide 31, which also may have an adjustable position according to a location of a second collar 36, may be located nominally opposite a midpoint of the second roll 16. The illustrated positions of first and second guides 30 and 31 are only examples, as positions of the first and second guides 30 and 31 may be adjusted in either a ganged fashion or independently according to needs or preferences of a user of the apparatus 10.

Stretch film from first and second rolls 15 and 16 may be threaded or otherwise passed through first and second guides 30 and 31 to form a first rope 50 and a second rope 51 of stretch film. It should be noted that there is no need to cut or otherwise modify, distort, or weaken the stretch film coming from the roll. Any such cutting, modifying, or distorting is obviated by the use of separate first and second rolls 15 and 16 of stretch film. Indeed, known devices that require cutting of stretch film or that employ cutting or distorting of stretch film in their operation may cause inconvenience and expense to users of the known devices as a result of consequential breaking and/or tearing of the stretch film.

It should be understood that the present disclosure contemplates using a plurality of rolls of stretch film and that first and second rolls 15 and 16 in the particular implementation illustrated in FIG. 1 are not intended to be limiting. Likewise, particular implementations of apparatus for securing palletized loads may comprise a plurality of guides (e.g., first and second guides 30 and 31, or more) being adjustably secured to a guide support member 20 by a plurality of collars (e.g., first and second collars 35 and 36). An implementation comprising such a plurality of rolls and guides may be employed to form a plurality of ropes (e.g., first and second ropes 50 and 51, or more) of stretch film with which to wrap or otherwise secure a palletized load.

Adjustment of positions of the guides (e.g., first and second guides 30 and 31) may be accomplished in one exemplary implementation using set screws (not shown) employed in the collars in a conventional manner. Adjustable clamps may replace the collars in other implementations without departing from any intention of the present disclosure.

Figure 2:
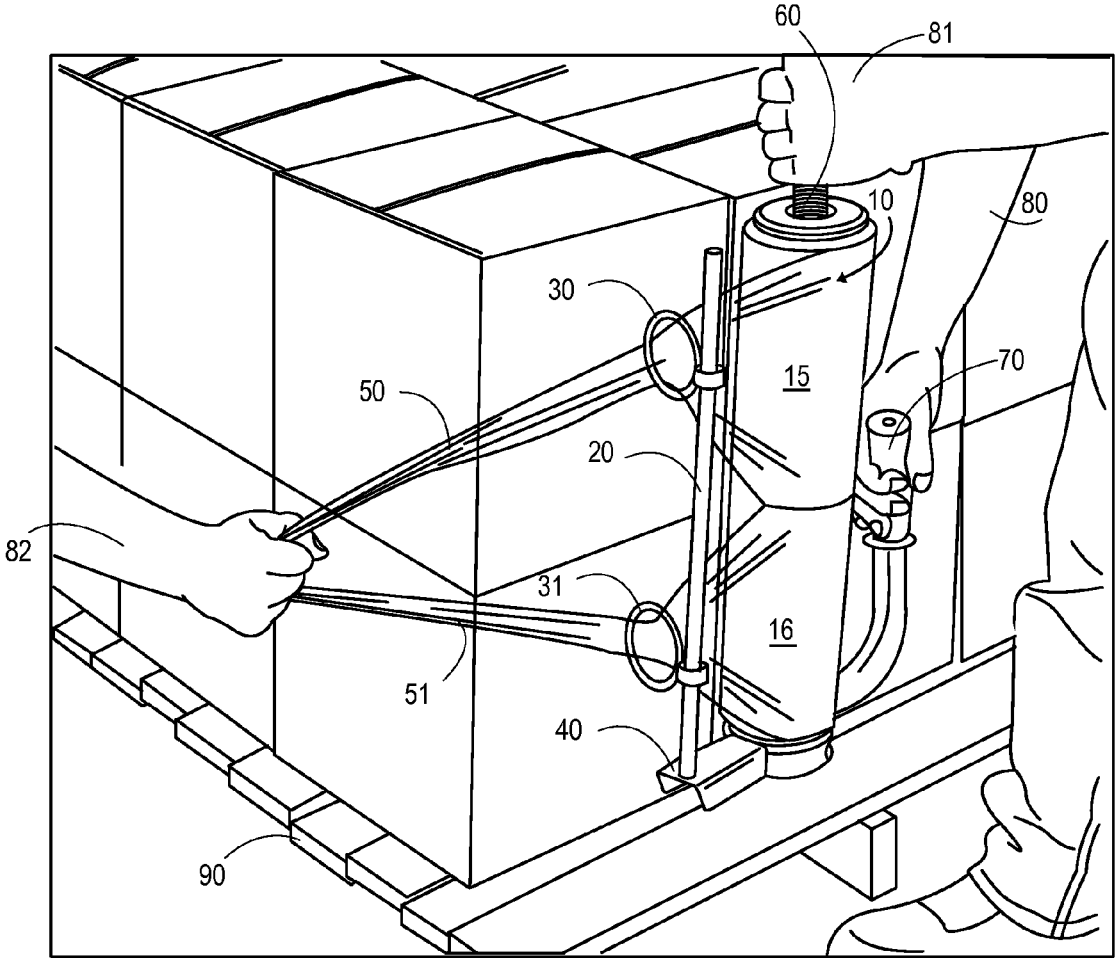
FIG. 2 is a pictorial diagram of the particular implementation of FIG. 1 illustrating hand-held use of the apparatus.

An axial handle 60 may be coupled to an end of the spool support member, the axial handle having an axis nominally aligned with the center axis shared by the spool support member and the first and second rolls 15 and 16 of stretch film. A side handle 70, further, may be affixed to the baseplate 40. A first user supporting the apparatus would hold both the axial handle 60 and the side handle 70. Arm 80 and hand 81 (See FIGS. 1 and 2) are from the user supporting the apparatus. A second user may draw the first and second ropes 50 and 51 using hand 82. The side handle 70 and the axial handle 60 may be employed by a user to support the particular apparatus 10 as illustrated in FIG. 2. Alternative or differently configured handles may be used. As is further illustrated in FIG. 2, the side handle 70 and the axial handle 60 may be employed by a user move the apparatus 10 around a palletized load in order to extend first and second ropes 50 and 51, thereby wrapping and/or securing the palletized load.

For example, a first user may support the apparatus 10 by using a hand on a first arm 80 to grasp the side handle 70 and a second hand 81 to grasp the axial handle 60. First and second ropes 50 and 51 may be grasped by a hand 82 of a second user to hold ends of the first and second ropes 50 and 51 while the first user circumnavigates (e.g., walks around) a palletized load situated on a nominally stationary pallet 90, thereby wrapping and securing the palletized load. In another particular implementation described more particularly with reference to FIG. 6, a pallet wrapping device remains stationary while a palletized load is rotated in order to accomplish wrapping of ropes of stretch film around the load.

Figure 3A:
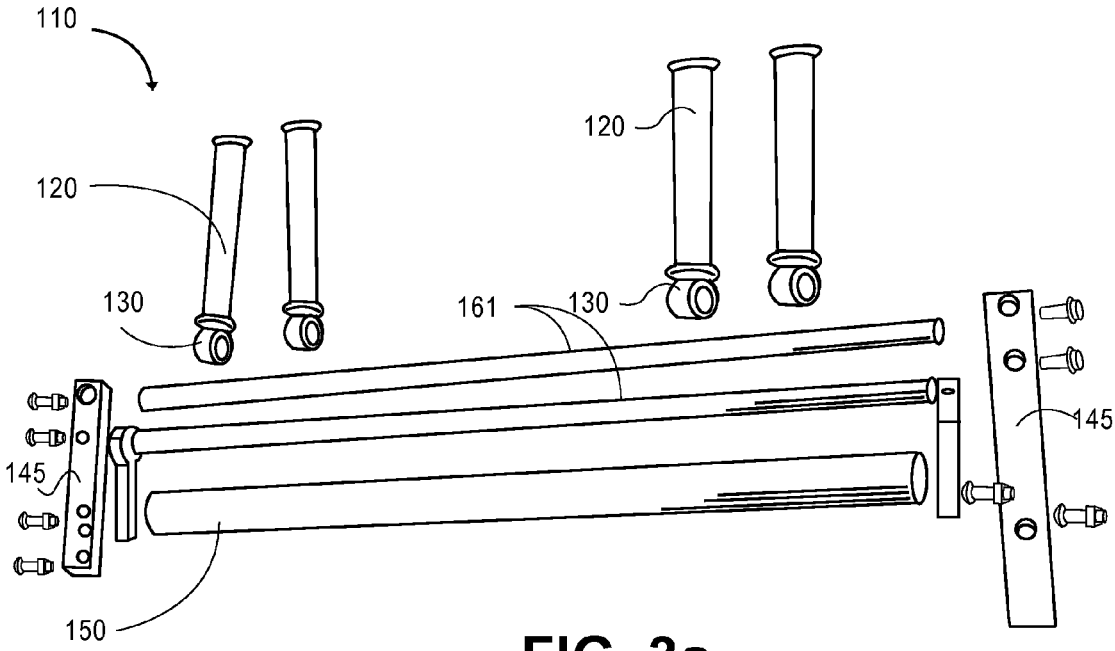
FIG. 3*a* is a disassembled view of a subassembly of another particular implementation of a palletized load-wrapping apparatus.
Figure 3B:
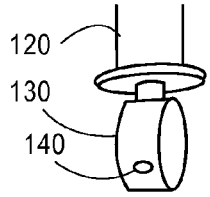
FIG. 3*b* is a close-up view of a portion of FIG. 3*a;*

FIG. 3*a* is a disassembled view of a subassembly 110 of a particular implementation of a stretch wrap machine 170 (FIG. 5), which may function as a palletized load-wrapping apparatus. Elements of this subassembly 110 of the stretch wrap machine 170 include a plurality of rollers 120 (four are shown in FIG. 3*a*), which may be used to form guides that may perform a function similar to first and second guides 30 and 31 introduced in FIGS. 1 and 2. The rollers 120 may have affixed thereto collars 130 that may slidably and adjustably fit over a rod 161 having first and second ends, the rod 161 being adapted to function as a supporting member for the plurality of rollers 120. The collars 130 may include set screws 140 suitable for facilitating adjustment of positions of the plurality of rollers 120 along the rod 161. The illustrated subassembly 110 further comprises a pair of brackets 145 adapted to provide mechanical support for the first and second ends of the rod 161. FIG. 3*b* is a close-up view of the collars 130, rollers 120 and set screws 140.

Figure 4:
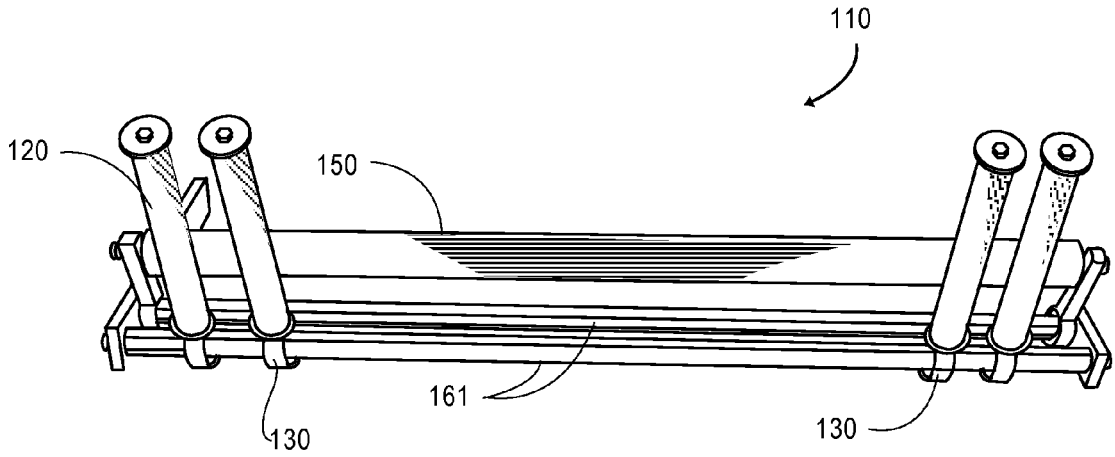
FIG. 4 is a view of the subassembly of FIG. 3*a* when assembled.

FIG. 4 is a partially-assembled subassembly 110 of FIG. 3*a* illustrating the plurality of rollers 120 affixed to the supporting member or rod 161 by collars 130. The partially-assembled subassembly 110 further includes a wrap machine roller 150 having ends mechanically secured by the pair of brackets 145 that also secure ends of the rod 161 in a manner well-understood by one skilled in the art.

Figure 5:
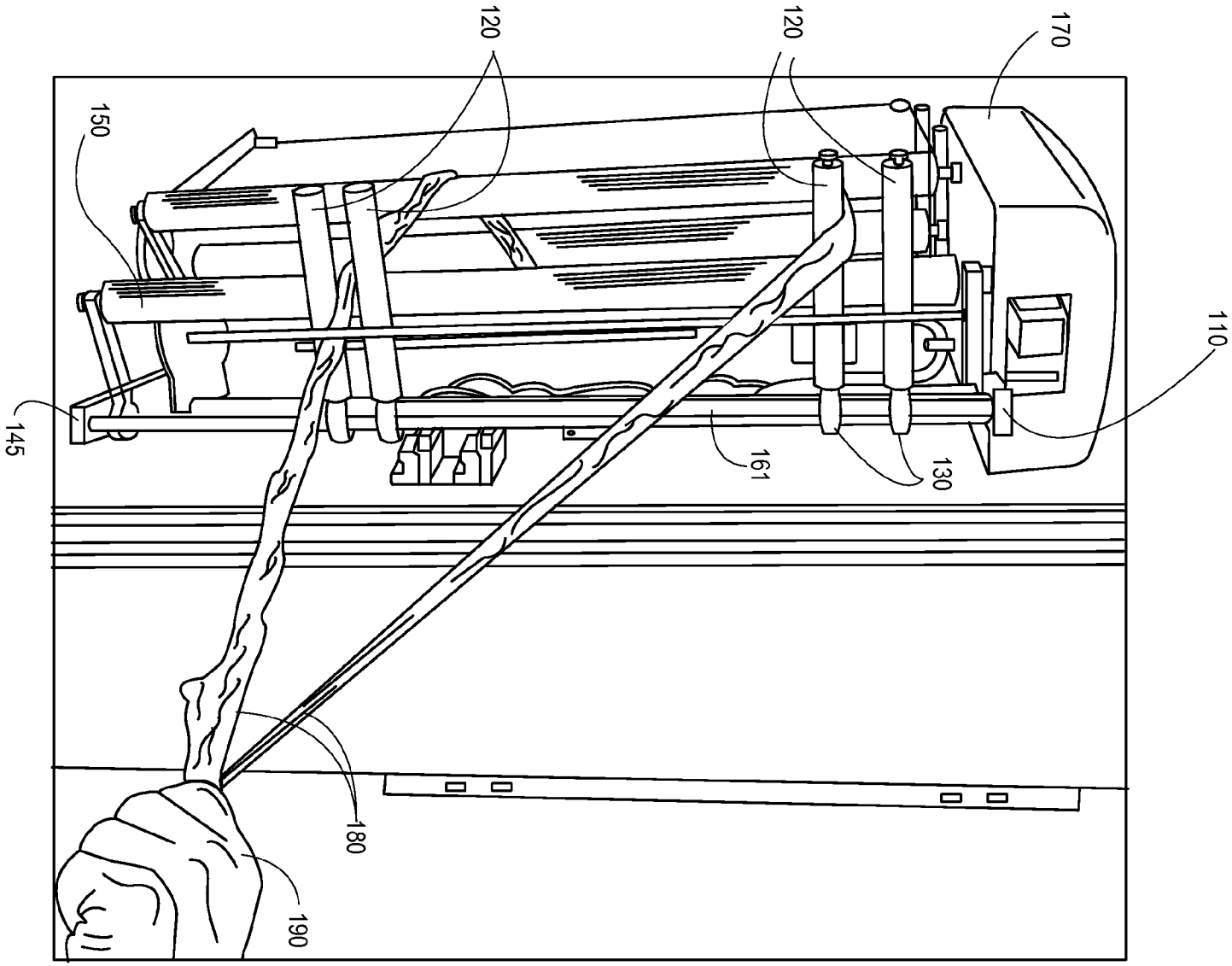
FIG. 5 is a pictorial diagram of a stretch wrap machine that includes a particular implementation of a rope-forming apparatus.

FIG. 5 is a pictorial diagram of a stretch wrap machine 170 that includes the subassembly 110 described above with reference to FIGS. 3 and 4. The stretch wrap machine 170, which may be employed as a palletized load-wrapping apparatus, may be configured for applications suited to wrapping palletized loads that arrive at the stretch wrap machine 170 on, for example, a conveyer belt, front loader or other transport medium. Typical implementations of the stretch wrap machine 170 include a rotating platform (not shown) on which may be placed a palletized load ready for wrapping. A driving mechanism (not shown) may cause the platform to rotate while a remainder of the stretch wrap machine 170 remains essentially stationary relative to the palletized load intended to be secured by the stretch wrap machine 170. It is understood that "stationary" in the present context means that the palletized load may be free to rotate, but that the load does not undergo translational motion once it arrives at the stretch wrap machine 170 until after any wrapping procedure is completed.

The implementation of the stretch wrap machine 170 illustrated in FIG. 5 comprises the subassembly 110 described in greater detail with reference to FIGS. 3 and 4. The illustrated implementation further comprises elements not shown in FIG. 5, but that may be similar to those illustrated in another implementation 270 of a stretch wrap machine shown in FIG. 6. These elements may include a spool 202, and a plurality of rolls of stretch film, e.g., first roll 215 and second roll 216 disposed essentially adjacently on the spool 202.

Returning to FIG. 5, stretch film may be passed between pairs of rollers 120, which may function as guides, thereby forming ropes 180 of stretch film. Although two pairs of rollers 120 and two ropes 180 are illustrated in FIG. 5, the description applies as well to a plurality of pairs of rollers, which may facilitate forming of a corresponding plurality of ropes of stretch film. As the palletized load rotates and a starting point for the plurality of ropes of stretch film is established on the palletized load, the palletized load may become wrapped with the plurality of ropes of stretch film.

Figure 6:
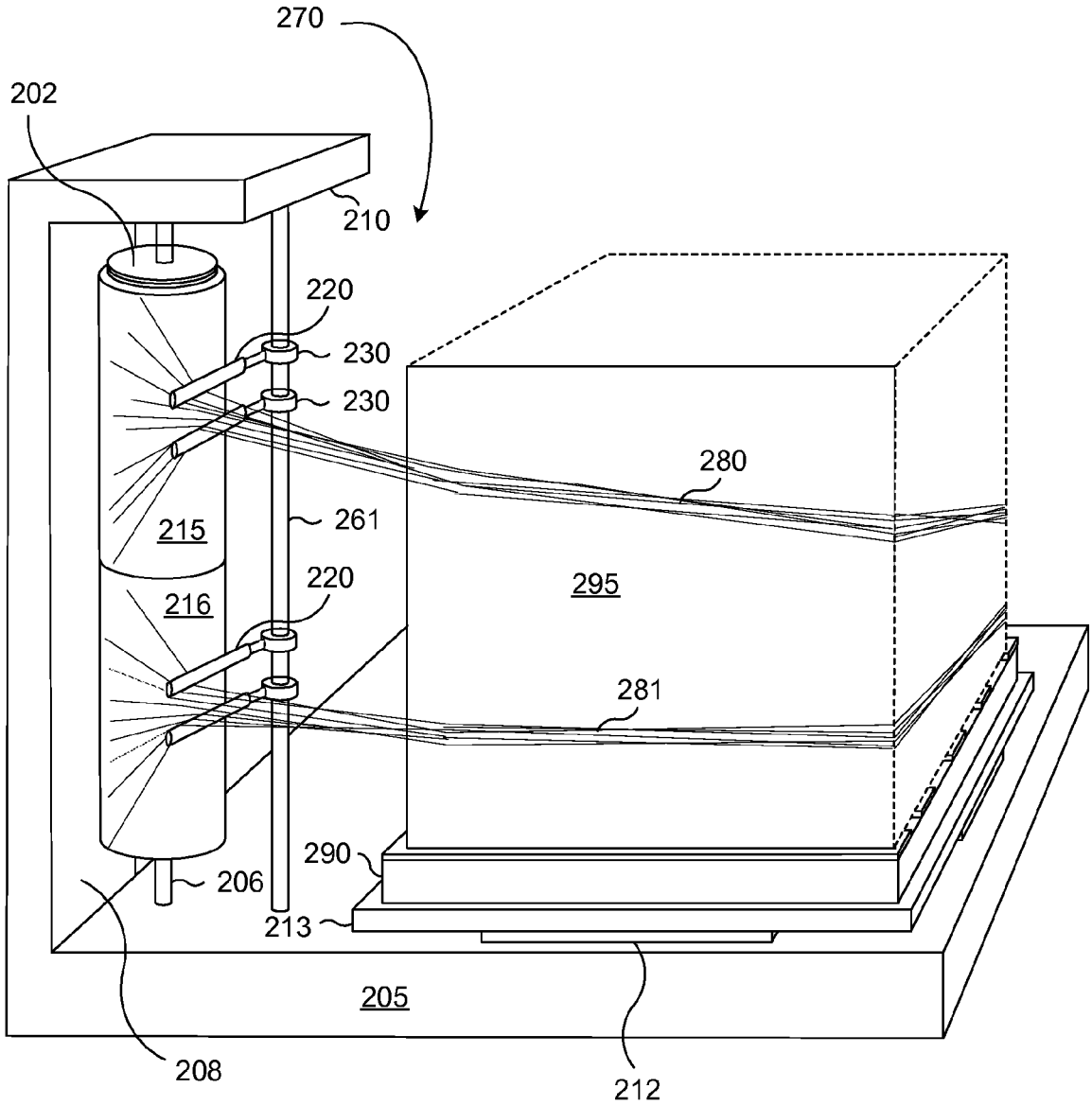
FIG. 6 is a pictorial diagram of a stationary stretch wrap machine.

FIG. 6 is a pictorial diagram of a stationary stretch wrap machine 270 that may include elements described with reference to FIG. 5. The illustrated implementation comprises a spool 202 mounted on a spool support member 206, which is anchored at a first end on a platform 205 and supported on a second end by a bracket 210 that is essentially rigidly connected with the platform 205 by a connecting member 208. The spool 202 has disposed (e.g., wound) thereon first and second rolls 215 and 216 of stretch film, axes of the first and second rolls 215 and 216 essentially coinciding with an axis of the spool 202. Typically, first and second rolls 215 and 216 are disposed next to each other on the spool. The first and second rolls 215 and 216 may be disposed directly on the spool or disposed on separate spools that are then disposed on a common spool or roller (e.g. a common core with two spools around it and coupled to it) with the purpose that the first and second rolls necessarily unroll at substantially the same rate. If the first and second rolls 215 and 216 do not spin at substantially the same rate, as is necessitated by being on the same spool 202 or being otherwise equivalently forced to spin at substantially the same rate, the operation is less effective.

A guide support member 261, which is supported at a first end by the platform 205 and at a second end by the bracket 210, may be disposed nominally parallel to and at a convenient distance from the spool 202. That is, guide support member 261 may have an axis that is parallel to the axis of the spool 202. A plurality of rollers 220, which may be arranged in pairs to form guides, two of which are illustrated, for example, in FIG. 6, are adjustably connected with the guide support member 261 by a plurality of collars 230. The collars 230 may be configured so that positions of the plurality of rollers 220 may be adjusted.

Stretch film from the first and second rolls 215 and 216 pass through a pair of guides (formed by pairs of rollers 220 in the implementation shown in FIG. 6), forming first and second ropes 280 and 281 of stretch film. This disclosure, further, contemplates using two or more rolls, i.e., a plurality of rolls of stretch film in order to form a plurality of ropes of stretch film, by passing the stretch film through a plurality of guides although only two rolls, guides and ropes are illustrated in FIG. 6.

The platform 205 may have disposed thereon a support 212 that supports a rotatable platform 213 on which may be placed a pallet 290 of palletized goods 295 shown in dotted outline in FIG. 6 to reflect an arbitrary nature of an arrangement of the palletized goods 295. In operation, the pallet 290 and the palletized goods 295 may arrive at the stretch wrap machine 270 and may be placed onto the rotatable platform 213. First and second ropes 280 and 281 of stretch film may be formed as described herein and attached at initial ends (not illustrated) to the palletized load 295 in a known manner. The rotatable platform 213 then may be rotated (using, for example, a known type of motor and shaft arrangement not shown in FIG. 6), thereby pulling stretch film through the guides and extending first and second ropes 280 and 281 to wrap the palletized goods 295 as already described. It may be well to point out that although the stretch wrap machine 270 includes a rotating platform 213, portions of the stretch wrap machine 270 that form the stretch ropes 280 and 281 (i.e. the palletized load-securing apparatus) are fixed relative to the palletized load 295 being secured and relative to the rotatable platform 213.

Figure 7:
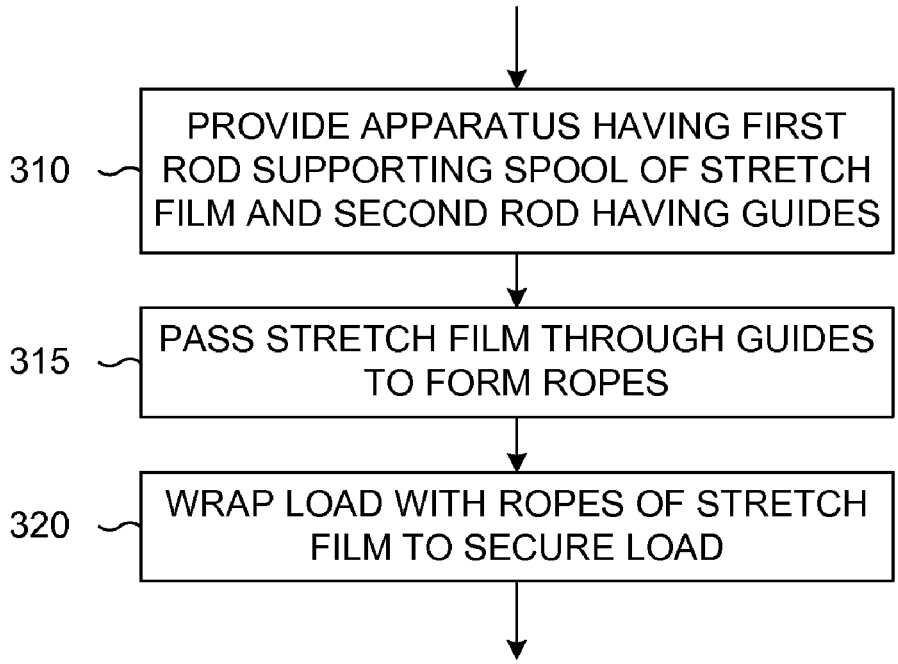
FIG. 7 is a flow diagram describing a particular implementation of a method of securing a palletized load.

FIG. 7 is a flow diagram describing a particular implementation of a method of securing a palletized load. According to this implementation of the method, an apparatus is provided, the apparatus having a first rod that supports a single spool supporting a plurality of rolls of stretch film and a second rod that supports a plurality of guides (step 310). The plurality of rolls of stretch film may be disposed on the single spool in essentially adjacent positions, i.e., substantially contiguously. As a particular example, the apparatus described supra with reference to FIG. 6 may be provided, wherein the apparatus comprises a spool support member 206, which may be a rod, supporting the spool 202 on which are wound first and second rolls of stretch film 215 and 216 disposed substantially contiguously. The second rod of the implementation of FIG. 7 may be implemented as, for example, the guide support member 261 illustrated in FIG. 6, the guide support member 261 being rigidly supported by the platform 205 and the bracket 210, and having pairs of guides 220 adjustably secured thereto by the plurality of collars 230.

The implementation of the method of FIG. 7 further comprises passing stretch film from the plurality of rolls through the plurality of guides to form a plurality of ropes of stretch film (step 315). As a specific example, FIG. 6 illustrates stretch film from first roll 215 and second roll 216 passing through guides formed by pairs of rollers 220 to form first rope 280 and second rope 281 of stretch film. As another example, FIG. 1 illustrates stretch film from first roll 15 and second roll 16 passing through ring-shaped first and second guides 30 and 31 to form first and second ropes of stretch film 50 and 51.

The implementation of the method illustrated in FIG. 7 still further comprises securing the palletized load by wrapping the palletized load with the plurality of ropes formed in step 315, thereby securing the palletized load (step 320). It should be noted that no cutting of stretch film is employed in the illustrated implementation of the method. Exemplary implementations of this securing step (i.e., step 320) are illustrated in FIGS. 2 and 5A. In FIG. 2, a user may transport a palletized load-wrapping apparatus around a palletized load, thereby securing the palletized load with first and second ropes 50 and 51 of stretch film. The first and second ropes 50 and 51 are formed by passing the stretch film through first and second guides 30 and 31. In FIG. 6, a stretch machine 270, operating as described herein, secures a palletized load 295 by wrapping first and second ropes 280 and 281 around the palletized load 295 as the palletized load 295 rotates. First and second ropes are formed by passing stretch film through guides formed by pairs of rollers 220. Neither the implementation of FIG. 2 nor the implementation of FIG. 6 includes a mechanism for cutting stretch film, nor does the implementation of FIG. 7 contemplate any cutting of stretch film.

Figure 8:
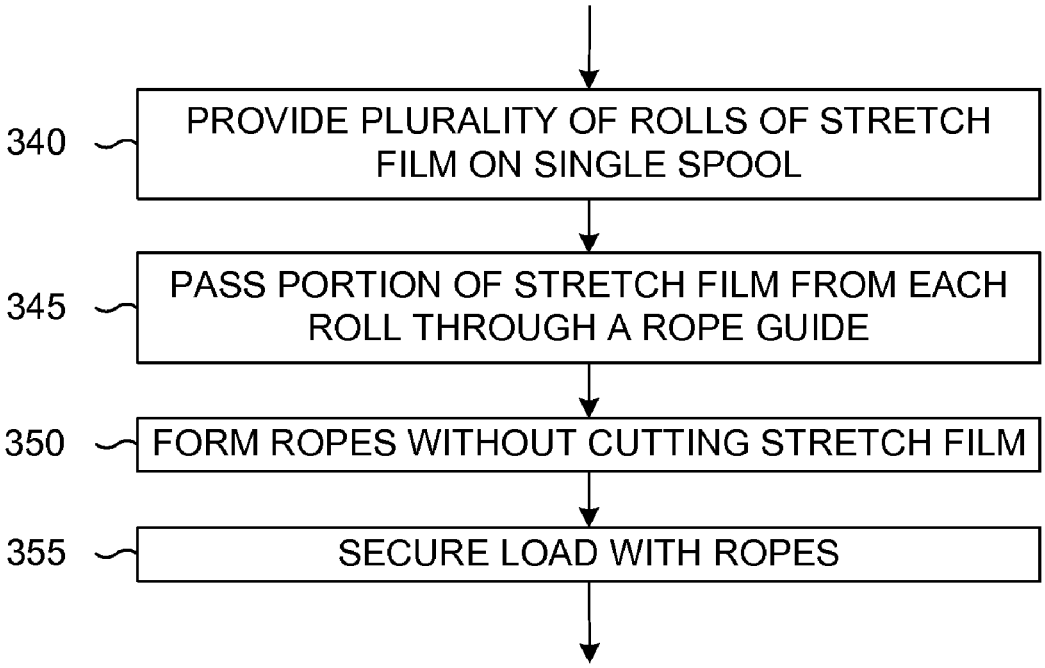
FIG. 8 is a flow diagram describing a particular implementation of a method of protecting a palletized load.

FIG. 8 is a flow diagram describing another particular implementation of a method of protecting a palletized load. According to the illustrated implementation, a plurality of rolls of stretch film (e.g., two or more rolls) is provided on a single spool (step 340). In a typical implementation, the single spool has an axis. A particular implementation that provides a plurality of rolls of stretch film is illustrated in FIG. 1, wherein is illustrated first and second rolls 15 and 16 of stretch film provided essentially contiguously positioned on a single spool 2. Another particular implementation that provides such a plurality of rolls of stretch film is shown in FIG. 6, which shows first and second rolls 215 and 216 on single spool 202.

The implementation of FIG. 7 further comprises passing a portion of stretch film from each roll through a rope guide (step 345). For example, stretch film from each of the first and second rolls 15 and 16 of stretch film may be passed through respective first and second guides 30 and 31 (functioning as rope guides) in the particular implementation shown in FIG. 1. As another example, FIG. 6 illustrates stretch film from each of first and second rolls 215 and 216 of stretch film passed through guides formed by pairs of rollers 220, the guides functioning as rope guides.

The implementation of FIG. 8 still further comprises forming a plurality of ropes without cutting the stretch film (step 350). One particular implementation of a method of forming the plurality of ropes is illustrated in the flow diagram of FIG. 9, described infra.

The implementation of FIG. 8 yet still further comprises securing the palletized load with the plurality of ropes (step 355). The securing may be accomplished using particular implementations already described. For example, FIG. 2 illustrates a pair of users cooperating to secure a palletized load. A first user (i.e. one having first arm 80 and second hand 81) moves around a palletized load while supporting an apparatus 10 adapted to form first and second ropes 50 and 51 of stretch film. A second user having hand 82, grasps initial ends of the first and second ropes 50 and 51. As the first user moves around the palletized load, the first and second ropes 50 and 51 become extended, wrapping, and thereby securing, the palletized load. As another example, a palletized load 295 may be secured as illustrated in FIG. 6 by first and second ropes 280 and 281 of stretch film formed by a stretch wrap machine 270 operating as described herein. As the palletized load 295 rotates on the rotatable platform 213, first and second ropes are extended and wrapped around the palletized load 295 to secure the palletized load 295.

Figure 9:
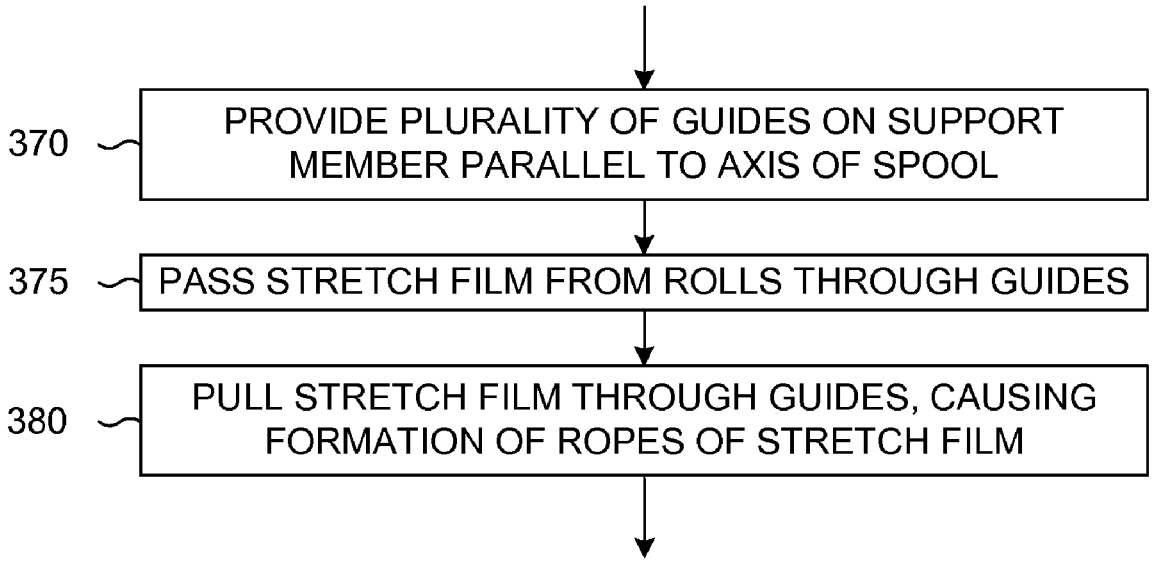
FIG. 9 is a flow diagram depicting a particular implementation of a method of forming a plurality of ropes according to the flow diagram of FIG. 8.

FIG. 9 is a flow diagram depicting a particular implementation of a method of forming a plurality of ropes according to the flow diagram of FIG. 8. The illustrated implementation comprises providing a plurality of guides (step 370) adjustably secured to a support member disposed parallel to the axis of the spool referenced in step 340 of FIG. 8. For example, the providing of guides may be accomplished as illustrated in FIG. 2, wherein first and second guides 30 and 31 are adjustably secured to guide support member 20 by first and second collars 35 and 36. Guide support member 20 is secured in a position having its axis oriented in a direction parallel to an axis of the spool 2 by baseplate 40. In FIG. 6, a pair of guides is provided, each guide formed by a pair of rollers 220 adjustably secured to a guide support member 261 by collars 230, wherein the axis of the guide support member 261 is nominally parallel to the axis of the spool 202 as already described. The particular implementation of FIG. 9 further comprises passing stretch film from the plurality of rolls through the plurality of guides (step 375). See, for example, FIG. 1, wherein stretch film from first roll 15 and second roll 16 is passed through, respectively, first guide 30 and second guide 31. Similarly, in FIG. 6, stretch film from first roll 215 passes through a guide formed by a pair of rollers 220, and stretch film form second roll 216 passes through another guide formed by another pair of rollers 220.

The particular implementation of FIG. 9 still further comprises pulling stretch film through the plurality of guides in order to cause formation of the plurality of ropes of stretch film (step 380). This step may be accomplished as illustrated in FIG. 1 wherein, for example, first rope 50 is bunched up as stretch film from first roll 15 passes through the first guide 30, thereby forming the first rope 50. Additional ropes may be similarly formed. In FIG. 5, first rope 180 is formed when stretch film from a first roll is guided by a pair of rollers 120.

It should be emphasized that positions of guides in the particular implementations of methods described in FIGS. 6-8 are adjustable as described with reference to, for example, FIG. 1 and FIG. 6. In a case of guides formed as rings (see, for example, FIG. 1), the rings may be adjusted either in a ganged arrangement or independently. Likewise, the guides formed by rollers 220 (FIG. 6) may be three-way adjustable: 1) Pairs of rollers may be moved in a ganged fashion; 2) pairs of rollers may be moved independently; and 3) rollers forming a pair may be moved farther apart or closer together in order to change a characteristic of ropes of stretch film according to preferences of a user.

It will be understood that implementations are not limited to the specific components disclosed herein, as virtually any components consistent with the intended operation of a method and/or system implementation for securing palletized loads may be utilized. Accordingly, for example, although particular components may be disclosed, such components may comprise any shape, size, style, type, model, version, class, grade, gauge, measurement, concentration, material, weight, quantity, and/or the like consistent with the intended operation of a method and/or system implementation for a palletized load wrapping machine may be used.

In places where the description above refers to particular implementations of palletized load-wrapping apparatus, it should be readily apparent that a number of modifications may be made without departing from the spirit thereof and that these implementations may be applied to other forms of devices that secure palletized loads. In particular, the above description describes hand-held and stationary versions of palletized load-wrapping machines. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A method of securing a palletized load comprising:

providing an apparatus including:

a first rod supporting a single spool on which is positioned a plurality of rolls of stretch film disposed substantially contiguously;

a second rod essentially rigidly supported in a position substantially parallel to the first rod, the second rod having a plurality of guides adjustably secured thereto;

passing stretch film from the plurality of rolls through the plurality of guides; and securing the palletized load through wrapping the palletized load with a plurality of ropes formed by the stretch film after passing the stretch film through the plurality of guides without cutting.

2. The method of claim 1, wherein:

the plurality of rolls comprises two rolls; and the plurality of guides comprises a plurality of rings.

3. The method of claim 1, wherein the plurality of guides comprises rollers.

4. A method of protecting a palletized load, the method comprising:

providing a plurality of rolls of stretch film on a single spool;

passing a portion of the stretch film from each of the plurality of rolls through a rope guide;

forming a plurality of ropes from the plurality of rolls without cutting the stretch film; and securing the palletized load with the plurality of ropes.

5. The method of claim 4, wherein the providing of a plurality of rolls comprises providing two rolls.

6. The method of claim 4, wherein providing the plurality of rolls comprises positioning the plurality of rolls essentially contiguously on the single spool.

7. The method of claim 4, wherein the forming comprises:

providing a plurality of guides adjustably secured to a support member positioned essentially parallel to an axis of the spool;

passing stretch film from the plurality of rolls through the plurality of guides; and pulling the stretch film through the plurality of guides, whereby the plurality of guides causes formation of the plurality of ropes of stretch film.

8. The method of claim 7, wherein the providing of a plurality of guides comprises providing a plurality of guides having independently adjustable positions.

9. The method of claim 8, wherein the securing comprises rotating the palletized load relative to an essentially stationary position of support for the plurality of guides and wrapping the plurality of ropes around the palletized load.

10. The method of claim 8, wherein the securing comprises rotating the plurality of guides relative to an essentially stationary position of the palletized load and wrapping the plurality of ropes around the palletized load.

11. The method of claim 8, wherein the providing of a plurality of guides comprises providing a plurality of rings.

12. An apparatus for securing a palletized load, the apparatus comprising:

a spool support member;

a plurality of rolls of stretch film on a single spool, the spool being supported by the spool support member;

a guide support member oriented substantially parallel to the spool and sharing mechanical support with the spool support member;

a plurality of guides coupled to the guide support member, each guide having stretch film from a roll of the plurality of rolls passed through the guide, thereby forming a plurality of ropes of stretch film, each stretch film roll remaining uncut by the apparatus.

13. The apparatus of claim 12, wherein the plurality of rolls comprises two rolls.

14. The apparatus of claim 12, wherein the plurality of rolls comprises rolls positioned essentially contiguously on the spool.

15. The apparatus of claim 12, wherein a position of each of the plurality of guides is independently adjustable on the support member.

16. The apparatus of claim 15, wherein:

the apparatus is configured to be in an essentially stationary position relative to the palletized load being secured; and the palletized load is secured by rotating the palletized load relative to the apparatus, thereby wrapping a plurality of ropes of stretch film around the palletized load.

17. The apparatus of claim 15, wherein the plurality of guides comprises a plurality of rings.

18. The apparatus of claim 17, further comprising:

an axial handle coupled to an end of the spool, nominally aligned with an axis of the spool;

a side handle coupled to the spool support member, the axial and side handles being configured to support the apparatus when the axial and side handles are carried by a user;

wherein the palletized load is secured by the user carrying the apparatus and walking around the palletized load positioned on an essentially stationary platform.

* * * * *